US010974746B2

(12) United States Patent
Mayo et al.

(10) Patent No.: US 10,974,746 B2
(45) Date of Patent: Apr. 13, 2021

(54) SYSTEM AND METHOD FOR REMOTE CONTROL OF LOCOMOTIVES

(71) Applicant: General Electric Company, Schenectady, NY (US)

(72) Inventors: Thomas Clayton Mayo, Honeoye Falls, NY (US); Jeffrey Michael Wilczewski, Brighton, NY (US); Kenneth Tuttle, Pittsford, NY (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 693 days.

(21) Appl. No.: 15/463,742

(22) Filed: Mar. 20, 2017

(65) Prior Publication Data

US 2018/0265107 A1 Sep. 20, 2018

(51) Int. Cl.

| | |
|---|---|
| ***G05D 1/00*** | (2006.01) |
| ***B61L 27/00*** | (2006.01) |
| ***B61L 25/02*** | (2006.01) |
| ***B61L 15/00*** | (2006.01) |
| ***B61L 17/00*** | (2006.01) |

(52) U.S. Cl.

CPC ..... *B61L 27/0005* (2013.01); *B61L 15/0018* (2013.01); *B61L 17/00* (2013.01); *B61L 25/021* (2013.01); *B61L 25/025* (2013.01); *B61L 27/0038* (2013.01); *B61L 27/0077* (2013.01); *B61L 2201/00* (2013.01)

(58) Field of Classification Search

CPC .. B61L 27/0005; B61L 17/00; B61L 15/0018; B61L 25/021; B61L 25/025; B61L 27/0038; B61L 27/0077; B61L 2201/00; G05D 1/00

USPC ..... 701/1, 2, 19, 20, 36; 340/992, 993, 4.3; 370/346, 328, 337, 349

See application file for complete search history.

(56) References Cited

U.S. PATENT DOCUMENTS

| | | | | |
|---|---|---|---|---|
| 5,681,015 A * | 10/1997 | Kull | B60T 13/665 | 246/187 C |
| 5,862,502 A * | 1/1999 | Giers | B60T 8/885 | 303/122 |
| 6,854,691 B2 | 2/2005 | Kraeling et al. | | |
| 6,862,502 B2 * | 3/2005 | Peltz | B61L 3/125 | 246/187 C |

(Continued)

OTHER PUBLICATIONS

EP Extended Search Report for related application 18160282.2 dated Aug. 31, 2018; 9 pp.

(Continued)

*Primary Examiner* — Shardul D Patel

(74) *Attorney, Agent, or Firm* — Armstrong Teasdale LLP

(57) ABSTRACT

A system for remote control of locomotives over a single time division multiple access network is provided. The system includes a locomotive control unit configured to operatively control a locomotive. The locomotive control unit is suitable for transmitting and receiving information via the network. The system also includes at least two operator control units suitable for transmitting and receiving information via the network and a hump control unit suitable for transmitting and receiving information via the network. The network employs both spatial and frequency diversity for remote control. The locomotive control unit, the at least two operator control units, and the hump control unit will only transmit in a respective defined period of time.

19 Claims, 8 Drawing Sheets

(56) References Cited

U.S. PATENT DOCUMENTS

| | | | | |
|---|---|---|---|---|
| 7,535,865 | B2 * | 5/2009 | Aiken, II | B61L 3/127 340/992 |
| 7,653,465 | B1 * | 1/2010 | Geiger | B61L 3/127 701/19 |
| 8,050,809 | B2 * | 11/2011 | Geiger | H04B 7/2606 701/19 |
| 2003/0214417 | A1 * | 11/2003 | Peltz | B61L 3/125 340/4.3 |
| 2004/0100938 | A1 * | 5/2004 | Aiken, II | B61L 3/127 370/346 |
| 2004/0117076 | A1 | 6/2004 | Horst | |
| 2010/0168941 | A1 * | 7/2010 | Geiger | B61L 3/127 701/20 |
| 2013/0116865 | A1 * | 5/2013 | Cooper | B61L 17/00 701/20 |
| 2017/0120939 | A1 * | 5/2017 | Paden | B61L 3/127 |

OTHER PUBLICATIONS

Reinhard, Grolms et al., "Sequence Control in 32-bit Technology for the Marshalling Yard MuchenNord"; Signal + Draht, vol. 81, No. 10; published Oct. 1, 1989; pp. 207-214.

* cited by examiner

SYSTEM AND METHOD FOR REMOTE CONTROL OF LOCOMOTIVES

BACKGROUND

The field of the disclosure relates generally to the remote control of locomotives and, more particularly, to systems and methods for remotely controlling locomotives in a hump yard environment.

The railroad industry, through the Association of American Railroads (AAR) obtained the right to use radio spectrum in the 220 MHz band for remote locomotive control. The frequency allocation consists of at least two two-way radio channels. These channels are cleared nationwide and are being used for the Remote Control Locomotive (RCL) application. Additional channel pairs in the 220 MHz band may be used at specific locations where individual licenses have been obtained.

Rail yards are areas with many parallel tracks, where switching engines pull and push rail cars together to form trains. In a flat yard, the engines do all the work, and are run by remote control by conductors on the ground. In a hump yard, the engines push cars to a hump crest and then release the cars to have gravity propel the released cars to the desired location. Typically a computer program calculates the engine speed on the hump for efficient operation. Conductors share control of the engine with the computer program. Accordingly, due to the limited nature of available communication resources, there is a need to determine efficient communications between the computer program, the locomotive, and the conductors.

BRIEF DESCRIPTION

In at least one aspect, a system for remote control of locomotives over a single time division multiple access network is provided. The system includes the single time division multiple access network and a locomotive control unit configured to operatively control a locomotive. The locomotive control unit is suitable for transmitting and receiving information via the network. The system also includes at least two operator control units suitable for transmitting and receiving information via the network and a hump control unit suitable for transmitting and receiving information via the network. The network employs both spatial and frequency diversity for remote control. The locomotive control unit, the at least two operator control units, and the hump control unit will only transmit in a respective defined period of time.

In another aspect, a method for remote control of locomotives over a single time division multiple access network is provided. The method includes generating a first communication session between a locomotive control unit and two or more operator control units over the time division multiple access network. The network employs both spatial and frequency diversity. The locomotive control unit configured to operatively control a locomotive. The method also includes generating a second communication session between the locomotive control unit and a hump control unit over the time division multiple access network. The hump control unit is associated with a hump in a hump yard. The hump control unit is configured to operatively control the locomotive within a predetermined distance of the hump. The method further includes controlling the first communication session and the second communication session such that the at least two operator control units, the locomotive control unit, and the hump control unit will only transmit over the network in a respective defined period of time.

In yet another aspect, a hump gateway for remotely controlling locomotives over a single time division multiple access network is provided. The hump gateway includes at least one processor in communication with at least one memory device. The hump gateway is programmed to communicate with a locomotive control unit over the time division multiple access network. The network employs both spatial and frequency diversity. The locomotive control unit is in communication with two or more operator control units via the time division multiple access network. The locomotive control unit is configured to operatively control a locomotive. The hump gateway is also programmed to communicate with a hump control unit over a second network. The hump control unit is associated with a hump in a hump yard. The hump control unit is configured to operatively control the locomotive within a predetermined distance of the hump. The hump gateway is further programmed to time communication to and from the locomotive control unit so that the hump control unit, the two or more operator control units, and the locomotive control unit will only transmit in a respective defined period of time.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
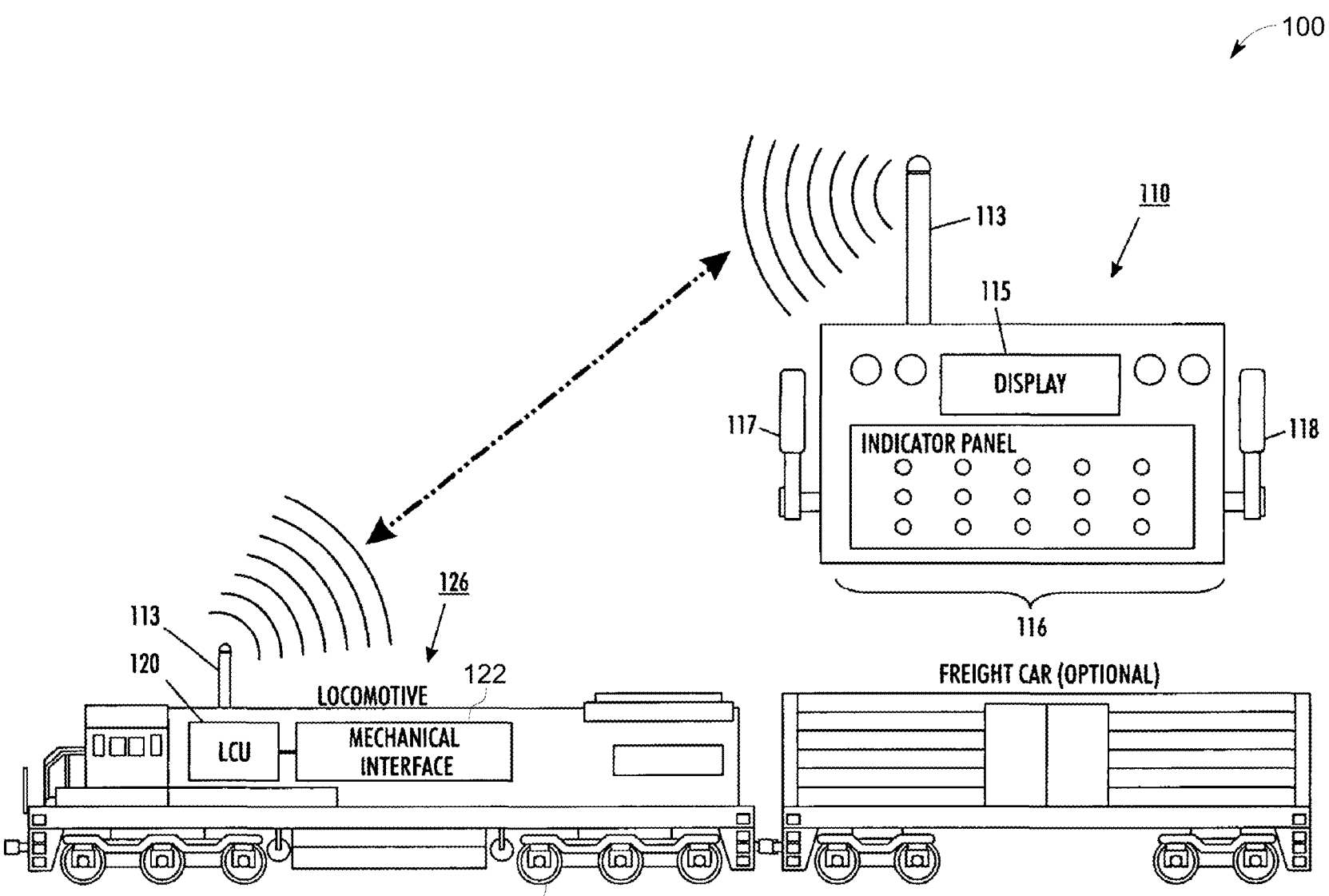
FIG. 1 is a schematic view of an exemplary locomotive communication system for providing remote control of a locomotive.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "processor" and "computer", and related terms, e.g., "processing device", "computing device", and controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The simulation system described herein provides a method for sharing limited communication channels between operators, locomotives, and hump controllers. Specifically, the embodiments described herein include a computing device that is configured to remotely control a locomotive over a hump in a hump yard. The computing device may communicate to the locomotive through a radio network with limited frequencies and channels. The computing device may specifically time communications between the hump controller, the locomotive, and the operators to improve the efficiency of the communications while preventing communication overlap.

FIG. 1 is a schematic view of an exemplary locomotive communication system 100 for providing remote control of a locomotive 126.

Locomotive communication system 100 includes an operator control unit (OCU) 110 that includes a housing 111, a display 115, an indicator/switch panel 116, a brake lever 117, and a throttle lever 118. OCU 110 also includes a controller (not shown) and a radio (not shown) having an antenna 113. The OCU controller generates signals that are transmitted via the radio to a locomotive control unit (LCU) 120 as will be described in detail below. The controller of Operator Control Unit (OCU) 110 in each unit operates in response to an operator's selection on the levers and switches, and in accordance with a set of pre-programmed instructions, to provide such features as Increase/Decrease Throttle, Apply/Release Brakes, change between Forward/Reverse, and Sound Horn/Bell in the Locomotive Control Unit (LCU) 120.

LCU 120 includes a similar controller and radio connection through antenna 113. LCU 120 includes a connection to a mechanical interface 122 for locomotive 126. In the exemplary embodiment, mechanical interface 122 controls one or more control surfaces 124 of locomotive 126 in order to provide both manual control, and/or override, of locomotive 126.

Figure 2:
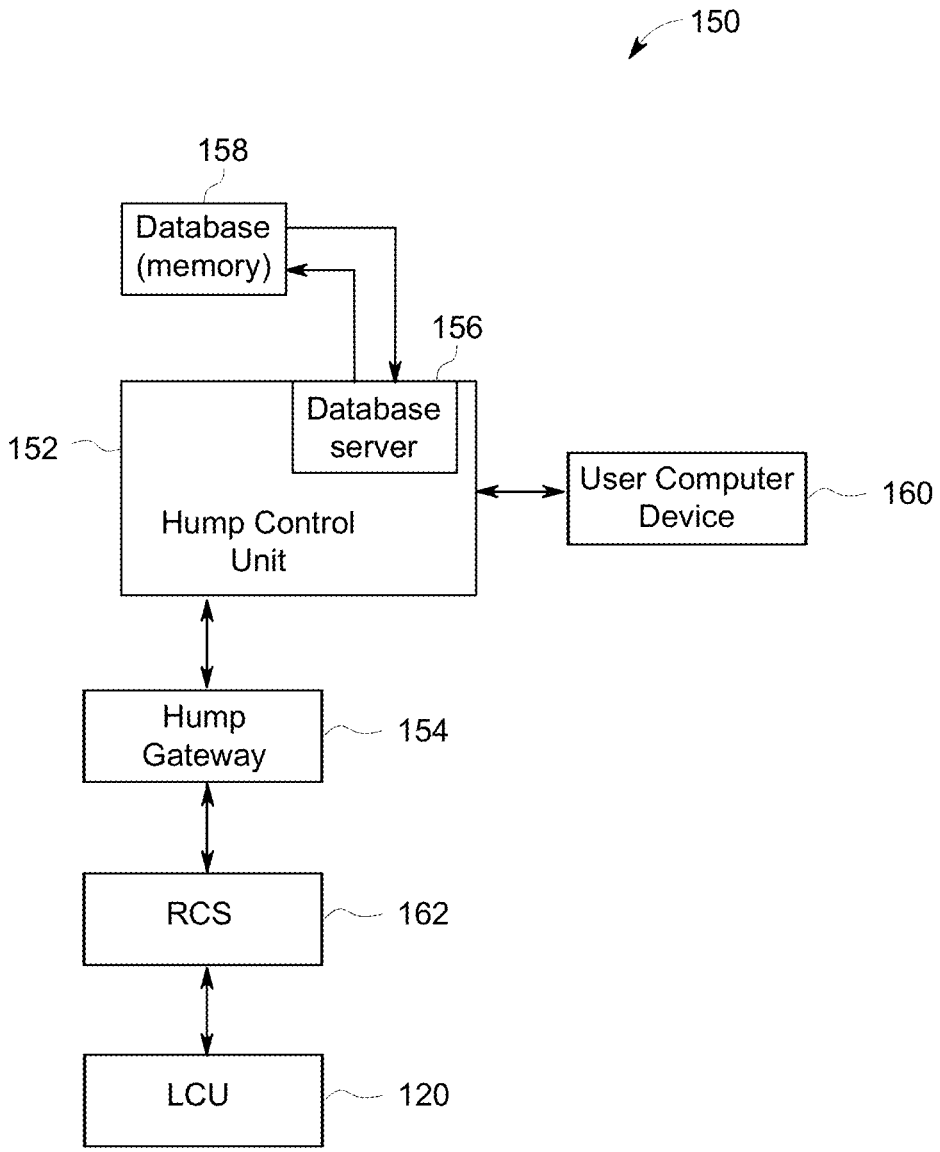
FIG. 2 is a schematic view of a hump control system for controlling a locomotive in a hump switching yard.

FIG. 2 is a schematic view of a hump control system 150 for controlling locomotive 126 (shown in FIG. 1) in a hump switching yard.

Hump control system 150 includes a hump control unit (HCU) 152 that is in communication with LCU 120. HCU 152 receives information from LCU 120 about locomotive 126, such as current location. HCU 152 transmits commands to LCU 120 to remotely control the actions of locomotive 126.

In the exemplary embodiment, locomotive 126 pushes one or more rail cars over a physical hump in the railyard. Once the one or more rail cars reach a crest point, gravity directs the rail cars down the hump and the rail cars travel to where they will be connected to other rail cars to form a train. HCU 152 calculates where on the hump that locomotive 126 should release the rail cars. Using that data, HCU 152 calculates the engine speed of locomotive 126 to get the rail cars to the release point. In the exemplary embodiment, HCU 152 receives the number, weight, and dimensions of the rail cars that are being pushed by locomotive 126 for the calculations from LCU 120. HCU 152 transmits the calculated information, such as the engine speed, to LCU 120. LCU 120 instructs mechanical interface 126 (shown in FIG. 1) based on the received information. In some rail yards, there are multiple humps, where each hump is associated with a corresponding HCU 202. In the exemplary embodiment, each HCU 152 is associated with one hump in the rail yard. In other embodiments, HCU 152 may control the flow of rail cars over multiple humps.

In the exemplary embodiment, HCU 152 communicates to LCU 120 through hump gateway 154 and Repeater Coordination Server (RCS) 162. In the exemplary embodiment, LCU 120 communicates on a wireless radio network as described herein. In the exemplary embodiment, HCU 152 is hosted on a wired computer network that is separate from the wireless radio network. In the exemplary embodiment, these two networks are bridged by hump gateway 154 and RCS 162. Hump gateway 154 controls the routing of messages between HCU 152 and RCS 162. RCS 162 controls the routing and timing of messages between LCU 120 and hump gateway 154. In some embodiments, hump gateway 154 routes communications to LCU 120 through one or more repeaters 210 (shown in FIG. 3). In the exemplary embodiment, hump gateway 154 is communicatively coupled to HCU 152 and to RCS 162 through various wired and wireless interfaces including, but not limited to, at least one of a network, such as the Internet, a local area network (LAN), a wide area network (WAN), or an integrated services digital network (ISDN), a dial-up-connection, a digital subscriber line (DSL), a cellular phone connection, and a cable modem. HCU 152 can be any device capable of accessing the Internet including, but not limited to, a desktop computer, a laptop computer, a personal digital assistant (PDA), a cellular phone, a smartphone, a tablet, or other web-based connectable equipment. In the exemplary embodiment, RCS 162 communicates with LCU 120 through a radio network, such as network 212 (shown in FIG. 3).

A database server 156 is coupled to a database 158, which contains information on a variety of matters, as described herein in greater detail. In one embodiment, centralized database 158 is stored on HCU 152. In an alternative embodiment, database 158 is stored remotely from HCU 152 and may be non-centralized. In some embodiments, database 158 includes a single database having separated sections or partitions or in other embodiments, database 158 includes multiple databases, each being separate from each other. Database 158 stores formula, data about the hump, operating data about one or more locomotives 126, and data about communication routing for commands. In some embodiments, a user is able to access database 158 by logging into HCU 152, such as through a user computer device 160.

In the exemplary embodiment, user computer devices 160 are computers or computer devices that include a web browser or a software application, which enables user computer devices 160 to access HCU 152 using a computer network. More specifically, user computer devices 160 are communicatively coupled HCU 152 through various wired and wireless interfaces including, but not limited to, at least one of a network, such as the Internet, a local area network (LAN), a wide area network (WAN), or an integrated services digital network (ISDN), a dial-up-connection, a digital subscriber line (DSL), a cellular phone connection, and a cable modem. User computer devices 160 can be any device capable of accessing the Internet including, but not limited to, a desktop computer, a laptop computer, a personal digital assistant (PDA), a cellular phone, a smartphone, a tablet, or other web-based connectable equipment.

Figure 3:
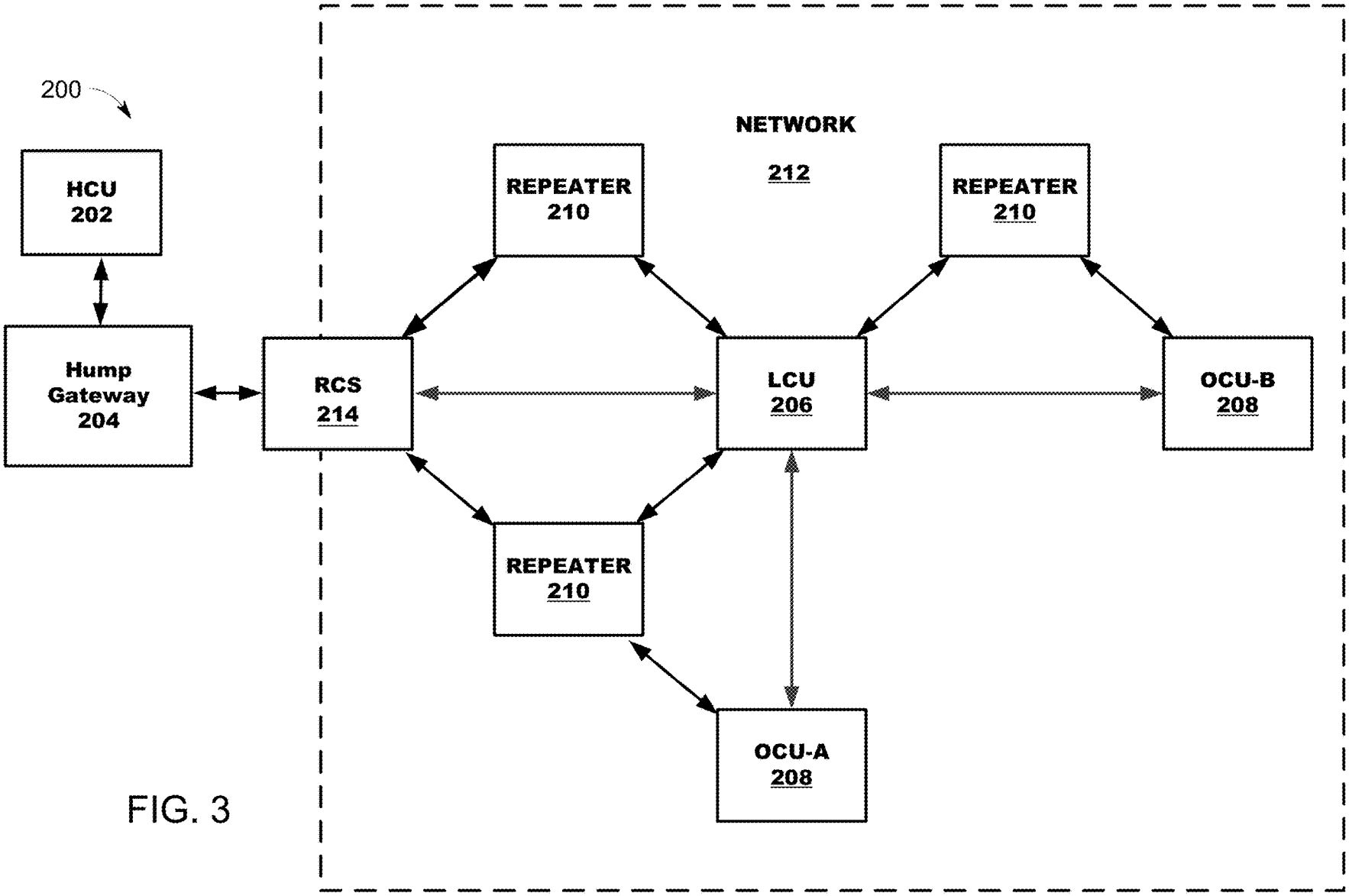
FIG. 3 is a schematic view of an exemplary remote control locomotive system to control a locomotive in a hump switching yard including the locomotive communication system shown in FIG. 1 and the hump control system shown in FIG. 2.

FIG. 3 is a schematic view of an exemplary remote control locomotive (RCL) system 200 to control a locomotive 126 (shown in FIG. 1) in a hump switching yard including locomotive communication system 100 (shown in FIG. 1) and hump control system 150 (shown in FIG. 2). RCL system 200 includes a Hump Control Unit (HCU) 202, which is similar to HCU 152 (shown in FIG. 1). HCU 202 is in communication with a hump gateway 204, which is similar to hump gateway 154 (shown in FIG. 2). RCL system 200 also includes Repeater Coordination Server (RCS) 214, which is similar to RCS 162 (shown in FIG. 2). Hump gateway 204 and RCS 214 control communication between HCU 202 and a network 212. RCL system 200 also includes a locomotive control unit (LCU) 206, which is similar to LCU 120 (shown in FIG. 1). Hump gateway 204 and RCS 214 route communication between LCU 206 and HCU 202.

In the exemplary embodiment, RCL system 200 also includes two OCUs 208, OCU-A and OCU-B. The OCUs are similar to OCU 110 (shown in FIG. 1). Each of OCU-A and OCU-B 208 are controlled by an operator. RCL system 200 also includes a plurality of repeaters 210 for communicating within network 212.

In the exemplary embodiment, RCL system 200 is used for facilitating a first communication session between LCU 206 and at least one of OCU-A 208 and OCU-B 208 and a second communication session between HCU 202 and LCU 206. In the exemplary embodiment, communications between HCU 202, LCU 206, OCU-A 208, and OCU-B 208 are conducted via radio communications, such as, but not limited to, the 220 MHz band. In the exemplary embodiment, OCUs 208, LCU 206, and hump gateway 204 communicate through network 212. Network 212 is a wireless network that uses a time division multiple access (TDMA) scheme to communicate over limited channels and frequencies. TDMA requires that a fixed period of time be divided into time intervals reserved specifically for transmissions from individual devices (e.g. OCUs 208 or LCUs 206). In the exemplary embodiment, network 212 uses a TDMA protocol scheme that provides multiple access to a radio frequency (RF) channel in the time domain.

Figure 7:
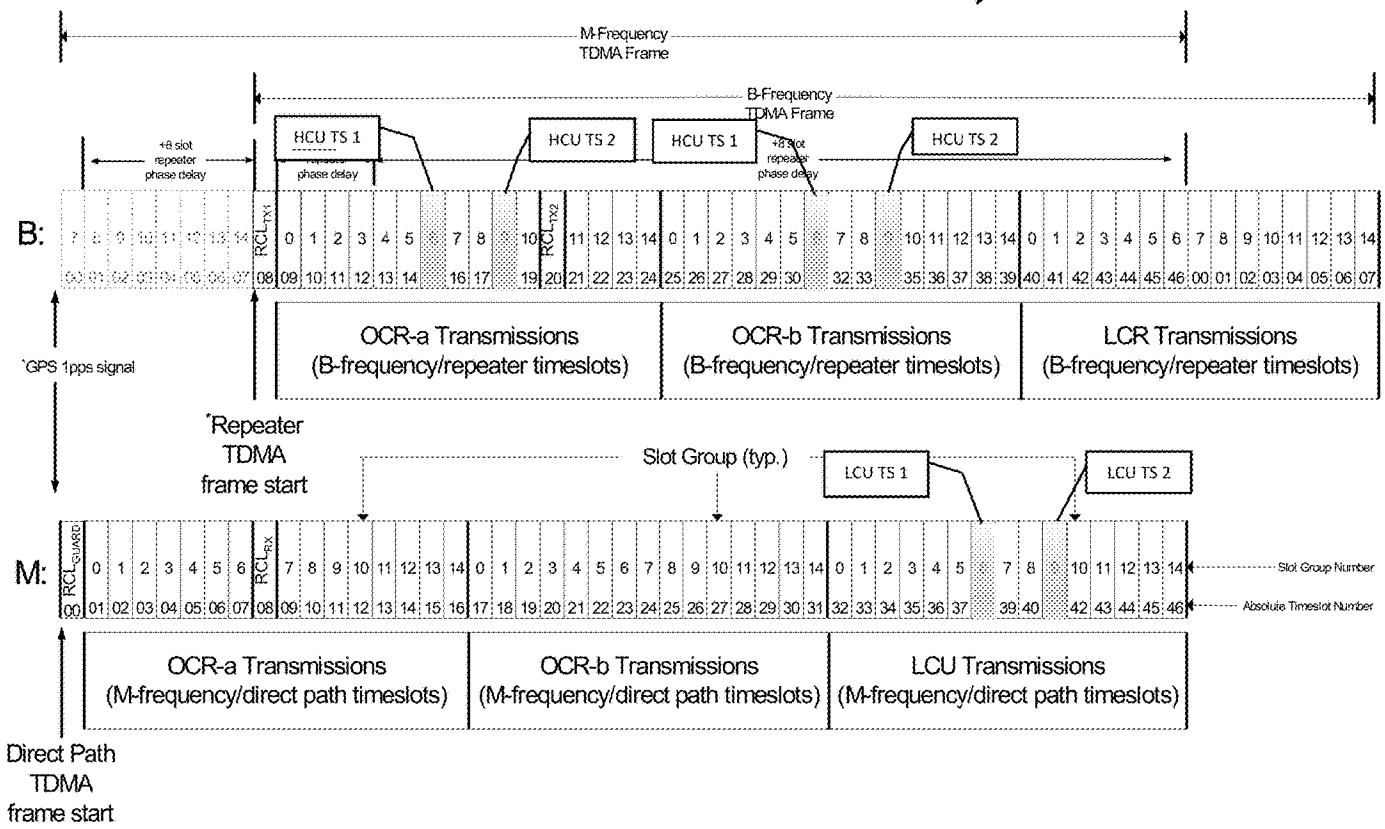
FIG. 7 illustrates an exemplary time division multiple access cycle and associated division of the time slots therein for a dynamic time slot allocation methodology.

In some embodiments, and as illustrated in detail below in FIGS. 7 and 8, a repeating one second frame is divided into multiple time slots, with slots assigned to individual systems. In the first communication session one block of time slots is dedicated to each of LCU 206, OCU-A 208, and OCU-B 208. In the second communication session one time slot in each block to HCU 202-LCU 206 communication, with one time slot dedicated for LCU 206 transmission and two time slots are dedicated for HCU 202 transmission. In these embodiment, the basic TDMA frame for the RCL system 200 repeats every second. This frame is divided into time slots that will be used by individual devices for their transmitted packets.

In the exemplary embodiments, repeaters 210 include a fixed radio device that serves to increase the reliable range of operation of network 212. Repeater 210 does this by re-transmitting radio transmissions it receives from LCUs 206, OCUs 208, and RCS 214. Repeaters 210 allow for optimum antenna placement and elevation, extended coverage area, and avoidance of obstacles in the direct RF path between OCU 208, LCU 206, and/or RCS 214.

In the exemplary embodiments, each unit directs its message to either a repeater or a peer device. Furthermore, a frequency pair is considered a channel. It consists of the repeater transmit frequency (the B frequency), and the receive/transmit frequency (the M frequency). In some embodiments, the basic function of repeater 210 is to receive transmissions on the M frequency of the channel, and, retransmit them on the B frequency of the channel. In some further embodiments, multiple repeaters 210 are controlled by RCS 214.

RCS 214 is a system that implements the logic necessary to coordinate the communications of multiple repeaters 210 in network 212. In some further embodiments, a yard may contain multiple RCL systems 200, wherein RCS 214 coordinates the operation of multiple repeaters 210 by dynamically routing repeater transmissions. The physical configuration of some yards may make it necessary to install multiple repeaters. In this situation, RCS 214 provides message routing and slot synchronization among the plurality of repeaters 210.

In the exemplary embodiment, RCL system 200 supports to communication modes in which channel and time slot usage is coordinated, Distributed and Centralized. Both of these modes utilize the TDMA frame structure as described herein.

In the exemplary embodiment, RCL system 200 operates in Distributed Coordination Mode (DCM) when it is not in coverage of available repeater infrastructure. This mode is generally applicable where communication demand is light or devices (OCUs 208 and LCUs 206) are capable of reliable communications without repeaters 210. Typical locations for DCM operation are in small yards or industries along the railroad line. In DCM, individual devices contend for and self-regulate shared usage of available radio channels.

In situations where the concentration or frequency of RCL activity does not justify coordinated repeater infrastructure, RCL systems 200 will operate in Distributed Coordination Mode (DCM). DCM operation can be used anywhere and should therefore be restricted to the two nationwide channels. In DCM, the LCU 206 and OCUs 208 communicate directly with one another.

RCL system 200 operates in Centralized Coordination Mode (CCM) when its LCU 206, OCU 208, and hump gateway 204 devices communicate directly or via repeaters 210 in slots coordinated by the repeater infrastructure. This is the default mode of operation when the repeater infrastructure is available. The Repeater infrastructure provides expanded communications coverage as well as broadcast information about channel and time slot availability for use by initializing RCL systems 200. By monitoring the repeater's broadcast transmissions during initialization, RCL system 200 is capable of selecting a channel and time slot that will be free of interference from other operating RCL systems 200.

In some embodiments, such as in areas where the concentration or coverage requirement of RCL systems 200 requires more than one repeater 210 to achieve coverage, Repeater Coordination Server (RCS) 214 interconnects and coordinates transmissions of multiple repeaters 210. It is crucial for only one repeater 210 to transmit on a channel in a given time slot to prevent message loss due to repeater transmission collisions. In this scenario, time slot assignments and tracking are handled centrally by RCS 214, which directs two or more repeaters. RCS 214 enables all repeaters to receive a message and have it transmitted by a repeater relay capability. In the exemplary embodiment, RCL system 200 operates on the M frequency when using DCM and operates on the B frequency when using CCM.

Figure 4:
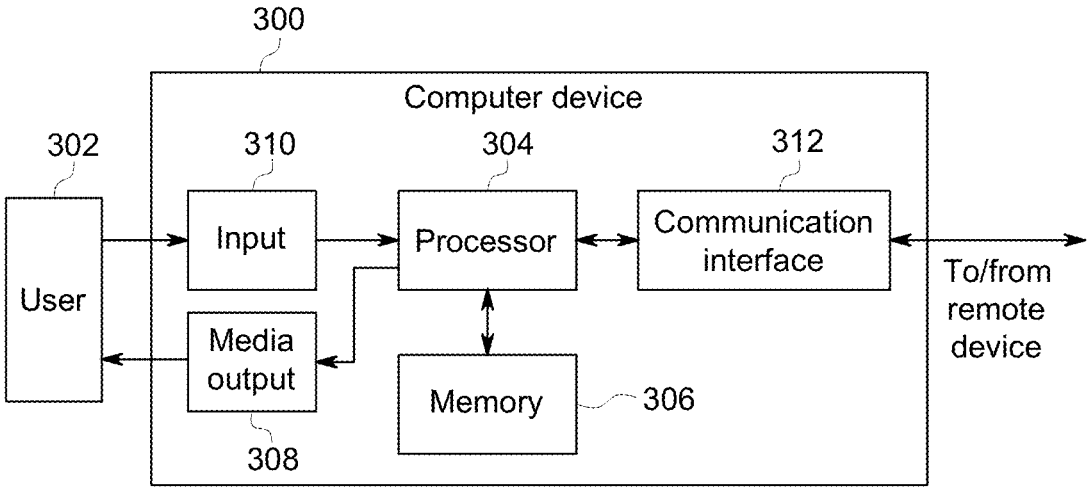
FIG. 4 is a schematic view of an exemplary configuration of a client system that may be used with the remote control locomotive system shown in FIG. 3.

FIG. 4 is a schematic view of an exemplary configuration of a client system that may be used with RCL system 200 (shown in FIG. 3). Computer device 300 is operated by a user 302. Computer device 300 may include, but is not limited to, OCU-A 208, OCU-B 208, LCU 206, (all shown in FIG. 3), and user computer device 160 (shown in FIG. 2). Computer device 300 includes a processor 304 for executing instructions. In some embodiments, executable instructions are stored in a memory area 306. Processor 304 may include one or more processing units (e.g., in a multi-core configuration). Memory area 306 is any device allowing information such as executable instructions and/or transaction data to be stored and retrieved. Memory area 306 includes one or more computer readable media. In some embodiments, memory area 306 includes database 158 (shown in FIG. 2). In some embodiments, memory area 306 is stored in computer device 300. In alternative embodiments, memory area 306 is stored remotely from computer device 300.

Computer device 300 also includes at least one media output component 308 for presenting information to user 302. Media output component 308 is any component capable of conveying information to user 302. In some embodiments, media output component 308 includes an output adapter (not shown) such as a video adapter and/or an audio adapter. An output adapter is operatively coupled to processor 304 and operatively coupled to an output device such as a display device (e.g., a cathode ray tube (CRT), liquid crystal display (LCD), light emitting diode (LED) display, or "electronic ink" display) or an audio output device (e.g., a speaker or headphones). In some embodiments, media output component 308 is configured to present a graphical user interface (e.g., a web browser and/or a client application) to user 302. In some embodiments, computer device 300 includes an input device 310 for receiving input from user 302. User 302 may use input device 310 to, without limitation, determine information about the hump. Input device 310 may include, for example, a keyboard, a pointing device, a mouse, a stylus, a touch sensitive panel (e.g., a touch pad or a touch screen), a gyroscope, an accelerometer, a position detector, a biometric input device, and/or an audio input device. A single component such as a touch screen may function as both an output device of media output component 308 and input device 310.

Computer device 300 may also include a communication interface 312, communicatively coupled to a remote device such as repeater 210 (shown in FIG. 3). Communication interface 312 may include, for example, a wired or wireless network adapter and/or a wireless data transceiver for use with a mobile telecommunications network or a local area network.

Stored in memory area 306 are, for example, computer readable instructions for providing a user interface to user 302 via media output component 308 and, optionally, receiving and processing input from input device 310. A user interface may include, among other possibilities, a web browser and/or a client application. Web browsers enable users, such as user 302, to display and interact with media and other information typically embedded on a web page or a website. A client application allows user 302 to interact with, for example, HCU 202 (shown in FIG. 3). For example, instructions may be stored by a cloud service, and the output of the execution of the instructions sent to the media output component 308.

Processor 304 executes computer-executable instructions for implementing aspects of the disclosure. In some embodiments, processor 304 is transformed into a special purpose microprocessor by executing computer-executable instructions or by otherwise being programmed. For example, processor 304 is programmed with instructions discussed further below.

Figure 5:
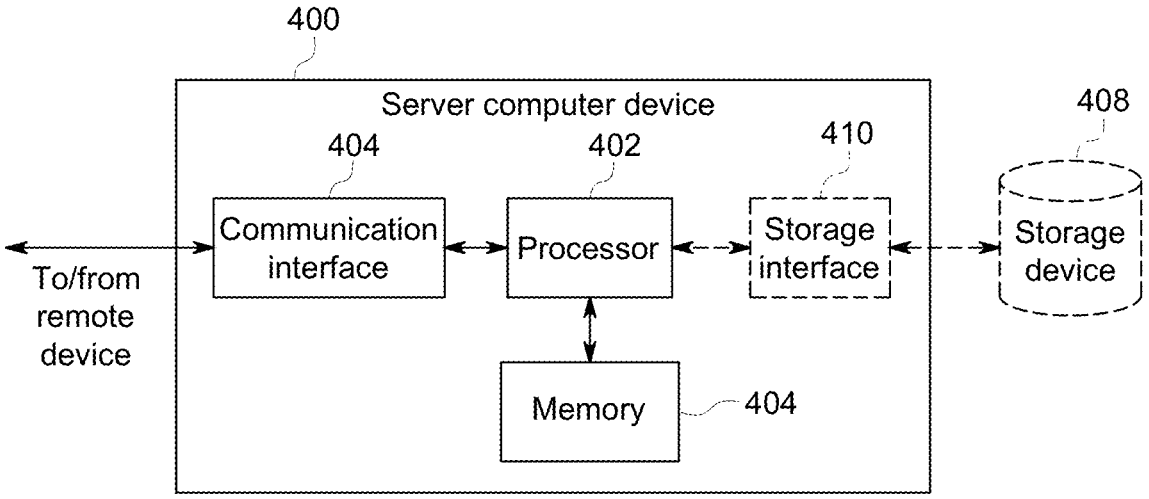
FIG. 5 is a schematic view of an exemplary configuration of a server system that may be used with the remote control locomotive system shown in FIG. 3.

FIG. 5 is a schematic view of an exemplary configuration of a server system that may be used with RCL system 200 (shown in FIG. 3). More specifically, server computer device 400 may include, but is not limited to, HCU 202, hump gateway 204, LCU 206, RCS (214) (all shown in FIG. 3), and database server 156 (shown in FIG. 2). Server computer device 400 also includes a processor 402 for executing instructions. Instructions may be stored in a memory area 404. Processor 402 may include one or more processing units (e.g., in a multi-core configuration).

Processor 402 is operatively coupled to a communication interface 406 such that server computer device 400 is capable of communicating with a remote device, such as another server computer device 400, HCU 202, hump gateway 204, LCU 206, OCU 208, repeater 210 (both shown in FIG. 3), or user computer devices 160 (shown in FIG. 2). For example, communication interface 406 may receive requests from user computer device 160, as illustrated in FIG. 2.

Processor 402 is also operatively coupled to a storage device 408. Storage device 408 is any computer-operated hardware suitable for storing and/or retrieving data, such as, but not limited to, data associated with database 158 (shown in FIG. 2). In some embodiments, storage device 408 is integrated in server computer device 400. For example, server computer device 400 may include one or more hard disk drives as storage device 408. In other embodiments, storage device 408 is external to server computer device 400 and is accessed by a plurality of server computer device 400. For example, storage device 408 may include a storage area network (SAN), a network attached storage (NAS) system, and/or multiple storage units such as hard disks and/or solid state disks in a redundant array of inexpensive disks (RAID) configuration.

In some embodiments, processor 402 is operatively coupled to storage device 408 via a storage interface 410. Storage interface 410 is any component capable of providing processor 402 with access to storage device 408. Storage interface 410 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 402 with access to storage device 408.

Processor 402 executes computer-executable instructions for implementing aspects of the disclosure. In some embodiments, the processor 402 is transformed into a special purpose microprocessor by executing computer-executable instructions or by otherwise being programmed. For example, the processor 402 is programmed with instructions as described further below.

Figure 6:
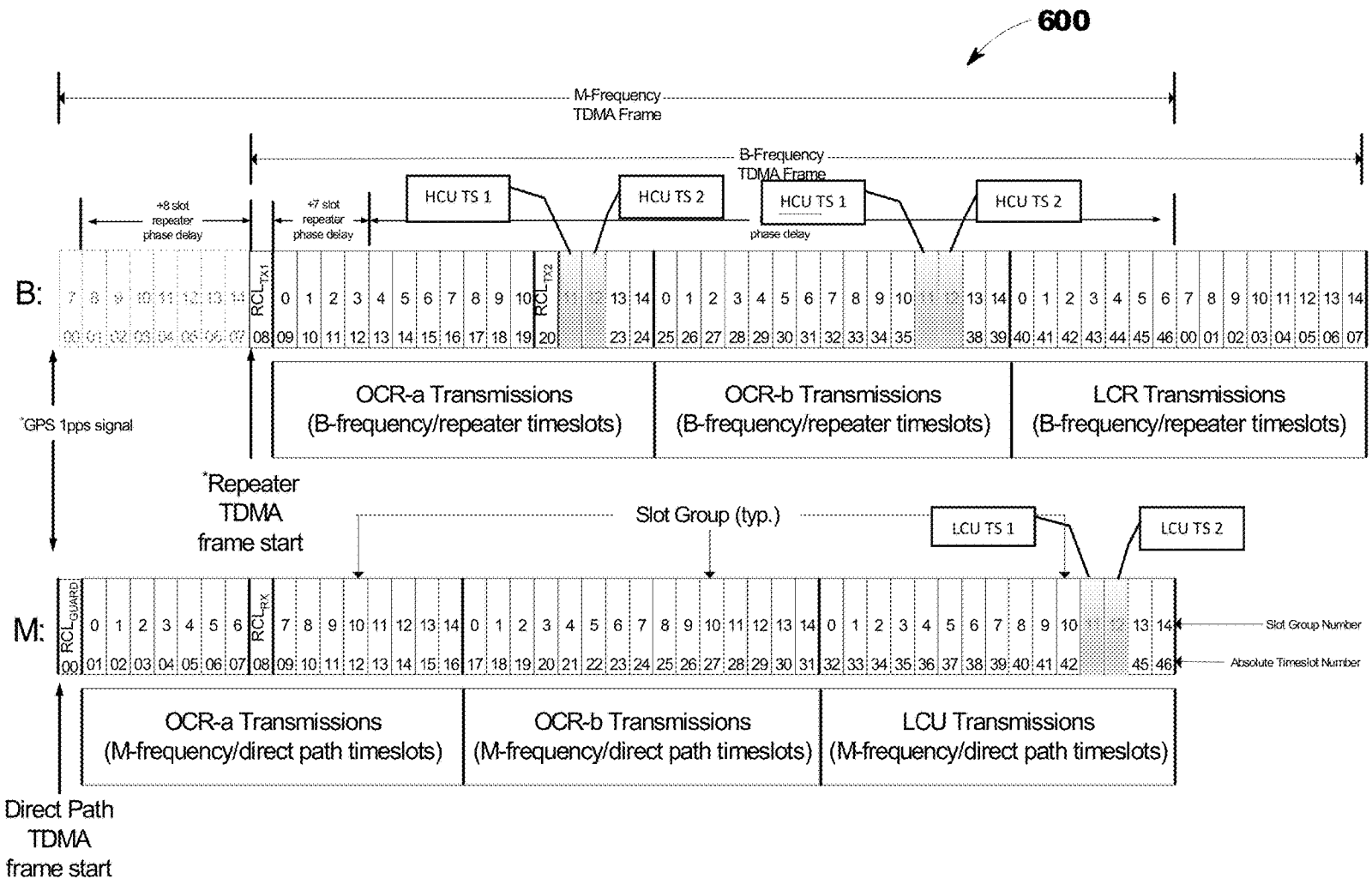
FIG. 6 illustrates an exemplary time division multiple access cycle and associated division of the time slots therein for a static time slot allocation methodology.

FIG. 6 illustrates an exemplary static time division multiple access cycle 600 and associated division of the time slots therein for a static time slot allocation methodology. FIG. 7 illustrates an exemplary dynamic time division multiple access cycle 700 and associated division of the time slots therein for a dynamic time slot allocation methodology.

In the exemplary embodiment, both static cycle 600 and dynamic cycle 700 illustrate communication frames for integrating the second communication session, between HCU 202 and LCU 206 (both shown in FIG. 3), with the first communication section between LCU 206 and OCUs 208 (shown FIG. 3).

Static cycle 600 and dynamic cycle 700 both include a repeating one-second frame that is divided into multiple time slots. During each time slot, a device may transmit a packet. For example, based on a 120-bit packet and a data transmission rate of 9600 bits per second, there are forty-seven sub-slots in each frame. The frame is further divided into three time blocks. As shown in FIG. 6, fifteen of the first seventeen time slots are assigned to OCU-A 208 for transmission. The next fifteen times slots are assigned to OCU-B 208 for transmission. The fifteen time slots are assigned to LCU 106 for transmission. Furthermore, the frames on the B frequency are offset by eight time slots from the frames on the M frequency.

Each RCL System 200 (shown in FIG. 3) needs three slots, one in each time block. The slots for RCL system 200 will be distributed across the TDMA frame in each of the time blocks. The group of three slots used to support the communications of RCL System 200. One time slot is reserved for repeater use in coordinating channel access. Therefore, fifteen communication sessions (meaning any combination of first communication sessions and second communication sessions up to a total of fifteen) will be able to share use of each radio channel.

During static cycle 600, a time slot is assigned to HCU 202 for transmission. As shown in FIG. 6, HCU 202 may transmit during HCU TS 1 or HCU TS 2. HCU TS 1 is positioned in the $11^{th}$ time slot in the OCU-A block of time slots. If HCU 202 transmits during one of these two time slots in OCU-A's block, then HCU 202 also transmits during the same time slot in OCU-B's block. LCU 206 transmits to HCU 202 during that time slot in its time slot block. For example HCU 202 would transmit during the $12^{th}$ slot of both OCU-A 208 and OCU-B 208 respective time slots. LCU 206 would then respond to HCU 202 in the $12^{th}$ slot of its time block.

In a static cycle 600, the times slots are known and consistent. For example, RCL system 200 may predefine the time slots within the block that may be used for communication between LCU 206 and HCU 202. In some embodiments, a single timeslot is defined. In other embodiments, two or more time slots may be defined. In these embodiments, RCL system 200 may pick one of the two or more time slots and consistently use that time slot for the second communication session. In still other embodiments, RCL system 200 changes the time slot used between frames. In the exemplary embodiment, the chosen time slot stays the same within the same frame.

In a dynamic cycle 700, the time slot used for communicating between LCU 206 and HCU 202 may change every frame. For example, in a first frame, the third time slot may be used in OCU-A's, OCU-B's, and HCU's time slots. In the next frame the seventh frame may be used instead. However, within the same frame, the chosen time slot stays the same between the time blocks. In some embodiments, RCL system 200 determines the slot to use randomly. In other embodiments, RCL 200 includes a priority system that allows it to assign time slots based on priority, tiered preferences, category, and the possibility of transmission issues.

In the exemplary embodiment, RCL systems 200 operate in Distributed Coordination Mode (DCM) in locations where repeater infrastructure and coverage does not exist. Interference possibly resulting from the operation of multiple RCL systems 200 in DCM within the same coverage area is minimized through use of a unique pseudo-random TDMA "DCM slot hopping" mechanism. This slot hopping sequence consists of a series of radio channels and timeslots through which RCL system 200 will advance with each transmitted packet. Transmission "hops" from slot to slot, allowing multiple RCL systems 200 to avoid channel and time slot collision with probabilistic certainty.

The DCM slot-hopping sequence consists of a sequence 29-long of channel and timeslot group identifiers that previously-associated LCU 206 and HCU 202 devices (or LCU 206 and OCU 208 devices) will cycle through for each packet transmission and receipt. The sequence is pre-coordinated between LCU 206 and HCU 202 devices (or LCU 206 and OCU 208 devices) and both step through the sequence, advancing the position in the sequence once per TDMA frame instance, in synchronized fashion, in order to coordinate transmission and receipt of packets. The sequence allows hopping amongst four pre-configured channels and fifteen timeslot groups (0-14) as depicted in FIG. 6, for example. Each item in the sequence defines the channel and timeslot group on which packet activity is to occur within the current TDMA frame.

As may be appreciated, the DCM slot-hopping pattern is used to maximize the number of RCL systems 200 that can operate in the same coverage area without coordination. In Decentralized Coordination Mode (DCM), the transmitting LCU 206 and HCU 202 devices (or LCU 206 and OCU 208 devices) send two messages during any one-second period. One message is sent on the channel "M" frequency and the other on the "B" frequency. Further, transmission hops to another slot from frame to frame, so interference between a given pair of RCL systems 200 does not repeat. The frequency pair on which packets are sent changes for each TDMA frame. By using both the M and the B frequencies to send messages each second, the system benefits from frequency diversity that significantly reduces the fade margin required for reliable operation.

In Centralized Coordination Mode (CCM), LCU 206 and HCU 202 devices (or LCU 206 and OCU 208 devices) send each message using two independent paths each second, to reduce fade margin and creating space and frequency diversity—thereby improving the probability of packet success. The first path is a direct transmission between the LCU 206 and HCU 202 devices (or LCU 206 and OCU 208 devices). The second path is via repeaters 210 (shown in FIG. 3), which may enhance coverage and received signal strength at the receiver. These are illustrated in FIG. 3. Repeater 210 receives transmissions on the M-frequency of the channel, and retransmits them on the B-frequency of the channel. Having this diversity significantly reduces the RF fade margin required for reliable operation.

In the exemplary embodiment, each TDMA frame has two slots (00, 12) reserved for beaconed information. In each beacon slot, repeater 210 transmits information about its coverage area and available slots on the channel. This transmission allows LCUs 206 operating in DCM to discover the repeater and transition modes when in range to utilize repeater 210. At a minimum, the infrastructure may operate on one channel. In addition, the infrastructure can communicate which timeslots are available on one other channel. In some embodiments, the infrastructure can communicate the frequencies for two additional channels (without timeslot information) so that RCL systems 200 can change frequencies.

Figure 8:
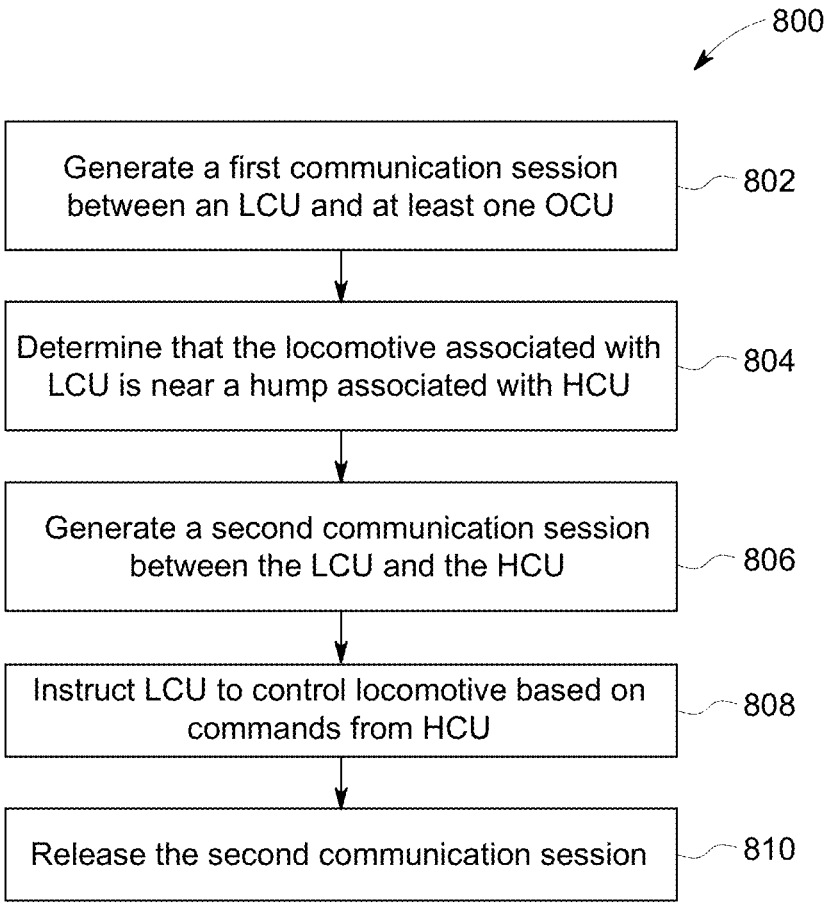
FIG. 8 is a flow chart of an exemplary process of remotely controlling locomotives in a hump yard environment using the remote control locomotive system shown in FIG. 2.

FIG. 8 is a flow chart of an exemplary process 800 of remotely controlling locomotives 126 (shown in FIG. 1) in a hump yard environment using RCL system 200 (shown in FIG. 3). In the exemplary embodiment, process 800 is performed by various components of RCL system 200 including HCU 202, hump gateway 204, LCU 206, and OCU 208 (all shown in FIG. 3).

In the exemplary embodiment, RCL system 200 generates 802 a first communication session between LCU 206 and one or more OCUs 208. As described above, the first communication session uses TDMA frames to allow for efficient communication between LCU 206 and the one or more OCUs 208.

RCL system 200 determines 804 that locomotive 126 (shown in FIG. 1) associated with LCU 206 is within a predetermined distance of the hump associated with HCU 202. In some embodiments, a sensor (not shown) detects that locomotive 126 is near to the hump. In other embodiments, location data, such as from a Global Positioning System (GPS), is used to determine 804 that locomotive 126 is near hump. In still other embodiments, operator of OCU 208 notifies HCU 202 that locomotive 126 is near hump. Based on the determination, RCL system 200 generates 806 a second communication session between LCU 206 and HCU 202 through hump gateway 204 and RCS 214. In the exemplary embodiment, communication between HCU 202, hump gateway 204, and RCS 214 is transmitted through Internet Protocol (IP) communication and the communication between RCS 214 and LCU 206 is transmitted through TDMA frames over radio waves.

Through the second communication session, HCU 202 receives data from LCU 206. HCU 202 instructs 808 LCU 206 to control locomotive 126 with speed information and other commands to push and release one or more rail cars over hump. RCL system 200 then releases or terminates 810 the second communication session between HCU 202 and LCU 206.

In some embodiments, HCU 202 only initiates second communication session when locomotive 126 is in the process of pushing rail cars over hump. In other embodiments, such as when there is only one hump, HCU 202 maintains the second communication session while locomotive is in the rail yard.

In some embodiments, HCU 202 only maintains one second communication session with only one LCU 206. In other embodiments, HCU 202 maintains multiple separate communication sessions with corresponding multiple LCUs 206.

The above-described method and systems provides a method for sharing limited communication channels between operators, locomotives, and hump controllers. Specifically, the embodiments described herein include a computing device that is configured to remotely control a locomotive over a hump in a hump yard. The computing device may communicate to the locomotive through a radio network with limited frequencies and channels. The computing device may specifically time communications between the hump controller, the locomotive, and the operators to improve the efficiency of the communications while preventing communication overlap.

An exemplary technical effect of the methods, systems, and apparatus described herein includes at least one of: (a) communicating between a hump controller and a locomotive; (b) remotely controlling a locomotive over a hump; (c) using pre-existing resources for communication; (d) transferring remote control of a locomotive between a hump controller and one or more operators; (e) improving coverage of radio communications in a hump yard environment; and (f) improving the efficiency of assembling trains in a hump yard.

Exemplary embodiments of methods, systems, and apparatus for remotely controlling locomotives are not limited to the specific embodiments described herein, but rather, components of systems and/or steps of the methods may be utilized independently and separately from other components and/or steps described herein. For example, the methods may also be used in combination with other systems requiring limited communication channels, and are not limited to practice with only the systems and methods as described herein. Rather, the exemplary embodiment can be implemented and utilized in connection with many other applications, equipment, and systems that may benefit from controlled communication sessions.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for remote control of locomotives over a single time division multiple access network, comprising:

the single time division multiple access network;

a locomotive control unit configured to operatively control a locomotive, wherein said locomotive control unit is suitable for transmitting and receiving information via the network;

at least two operator control units suitable for transmitting and receiving information via the network, including a first operator control unit and a second operator control unit; and a hump control unit suitable for transmitting and receiving information via the network, wherein said hump control unit is associated with a hump in a hump yard, and wherein said hump control unit is configured to operatively control the locomotive within a predetermined distance of the hump, wherein the network employs both spatial and frequency diversity for remote control, and wherein the locomotive control unit, the first operator control unit, the second operator control unit, and the hump control unit will only transmit in a respective defined period of time.

2. The system in accordance with claim 1, further comprising a hump gateway configured to route communications between said hump control unit and said locomotive control unit.

3. The system in accordance with claim 2, wherein said hump gateway is connected to said locomotive control unit through the single time division multiple access network and wherein said hump gateway is connected to the hump control unit through a separate network.

4. The system in accordance with claim 2, wherein said hump gateway is configured to generate a communication session between said hump control unit and said locomotive control unit.

5. The system in accordance with claim 4, wherein during the communication session said hump gateway transmits over the network for two time slots and receives over the network for one time slot and wherein said locomotive control unit transmits over the network for one time slot and receives over the network for two time slots.

6. The system in accordance with claim 4, wherein during the communication session said hump gateway dynamically allocates time slots for said locomotive control unit to transmit and receive.

7. The system in accordance with claim 6, wherein said hump gateway dynamically allocates time slots based on communications between said locomotive control unit and said operator control units.

8. The system in accordance with claim 1, wherein the network comprises a centralized coordination mode comprising a repeater infrastructure.

9. The system in accordance with claim 8, wherein said hump control unit communicates with the locomotive control unit via the centralized coordination mode.

10. The system in accordance with claim 8, wherein the repeater infrastructure communicates coverage area and defines periods of time for communication by the locomotive control unit, the at least two operator control units, and the hump control unit.

11. The system in accordance with claim 8, wherein the network further comprises a distributed coordination mode wherein said locomotive control unit communicates directly with said operator control units.

12. The system in accordance with claim 11, wherein the distributed coordination mode uses an uncorrelated time sequence that does not interfere with the single time division multiple access network.

13. The system in accordance with claim 12, wherein the locomotive control unit and the at least two operator control units use the centralized coordination mode simultaneously with the distributed coordination mode.

14. A method for remote control of locomotives over a single time division multiple access network, said method comprising:

generating a first communication session between a locomotive control unit and two or more operator control units, including a first operator control unit and a second operator control unit, over the single time division multiple access network, wherein the network employs both spatial and frequency diversity, wherein the locomotive control unit configured to operatively control a locomotive;

generating a second communication session between the locomotive control unit and a hump control unit over the single time division multiple access network, wherein the hump control unit associated with a hump in a hump yard, and wherein the hump control unit is configured to operatively control the locomotive within a predetermined distance of the hump; and controlling the first communication session and the second communication session such that the first operator control unit, the second operator control unit, the locomotive control unit, and the hump control unit will only transmit over the network in a respective defined period of time.

15. The method in accordance with claim 14 further comprising connecting the hump control unit to the single time division multiple access network via a hump gateway, wherein the hump gateway is configured to route communications between the hump control unit and the locomotive control unit.

16. The method in accordance with claim 15 further comprising:

transmitting, by the hump gateway, to the network for two time slots;

receiving, by the hump gateway, from the network for one time slot;

transmitting, by the locomotive control unit, to the network for one time slot; and receiving, by the locomotive control unit, from the network for two time slots.

17. The method in accordance with claim 15 further comprising dynamically allocating time slots for the locomotive control unit and the hump gateway to transmit and receive in the second communication session.

18. The method in accordance with claim 17 further comprising allocating time slots in the second communication session based on the first communication session.

19. A hump gateway for remotely controlling locomotives over a single time division multiple access network, said hump gateway comprising at least one processor in communication with at least one memory device, said hump gateway programmed to:

communicate with a locomotive control unit over the single time division multiple access network, wherein the locomotive control unit is in communication with two or more operator control units, including a first operator control unit and a second operator control unit, via the single time division multiple access network, wherein the network employs both spatial and frequency diversity, and wherein the locomotive control unit is configured to operatively control a locomotive;

communicate with a hump control unit over a second network, wherein the hump control unit associated with a hump in a hump yard, and wherein the hump control unit is configured to operatively control the locomotive within a predetermined distance of the hump; and time communication to and from the locomotive control unit so that the hump control unit, the first operator control unit, the second operator control unit, and the locomotive control unit will only transmit in a respective defined period of time.

* * * * *